United States Patent [19]

Blanz

[11] 4,262,756

[45] Apr. 21, 1981

[54] TORQUER/THRUSTER

[76] Inventor: John H. Blanz, 282 E. Riding Dr., Carlisle, Mass. 01741

[21] Appl. No.: 961,606

[22] Filed: Nov. 17, 1978

[51] Int. Cl.[3] ..... B23Q 5/00; E21C 5/00; B23Q 5/027; B23Q 5/033

[52] U.S. Cl. ..... 173/149

[58] Field of Search ..... 173/149, 53, 145, 146; 226/150, 162; 408/130, 239; 279/4

[56] References Cited

U.S. PATENT DOCUMENTS

| | | | |
|---|---|---|---|
| 2,638,324 | 3/1953 | Ball et al. | 173/149 |
| 2,730,331 | 1/1956 | Harinick | 173/149 |
| 2,965,273 | 12/1960 | Schoepe | 226/150 |
| 3,133,469 | 5/1964 | Jungberg | 226/150 X |
| 3,854,645 | 12/1974 | Knights | 226/162 |
| 4,128,133 | 5/1978 | Hug | 173/149 |

*Primary Examiner*—Ronald Feldbaum

*Attorney, Agent, or Firm*—Herbert L. Bello

[57] ABSTRACT

A torquer/thruster with a hydrostatically actuated chuck assembly having an elastomeric bladder that is fitted about a cylindrical collet into which a flexible roof drill is received. The collet is formed with a series of spaced slits that are disposed in helical paths, portions of the collet between the slits drivingly engage the drill shaft when the bladder is urged against the collet. The collet and bladder are mounted for rotational movement within a piston assembly that is constrained for limited longitudinal movement and fixed against rotational movement. The collet and bladder are moved longitudinally by the piston assembly for applying thrust to the roof drill and are rotatably driven by a rotary driver for applying torque to the roof drill. A pair of driven biased members engage the shaft and provide thrust assistance and retraction of the roof drill.

15 Claims, 4 Drawing Figures

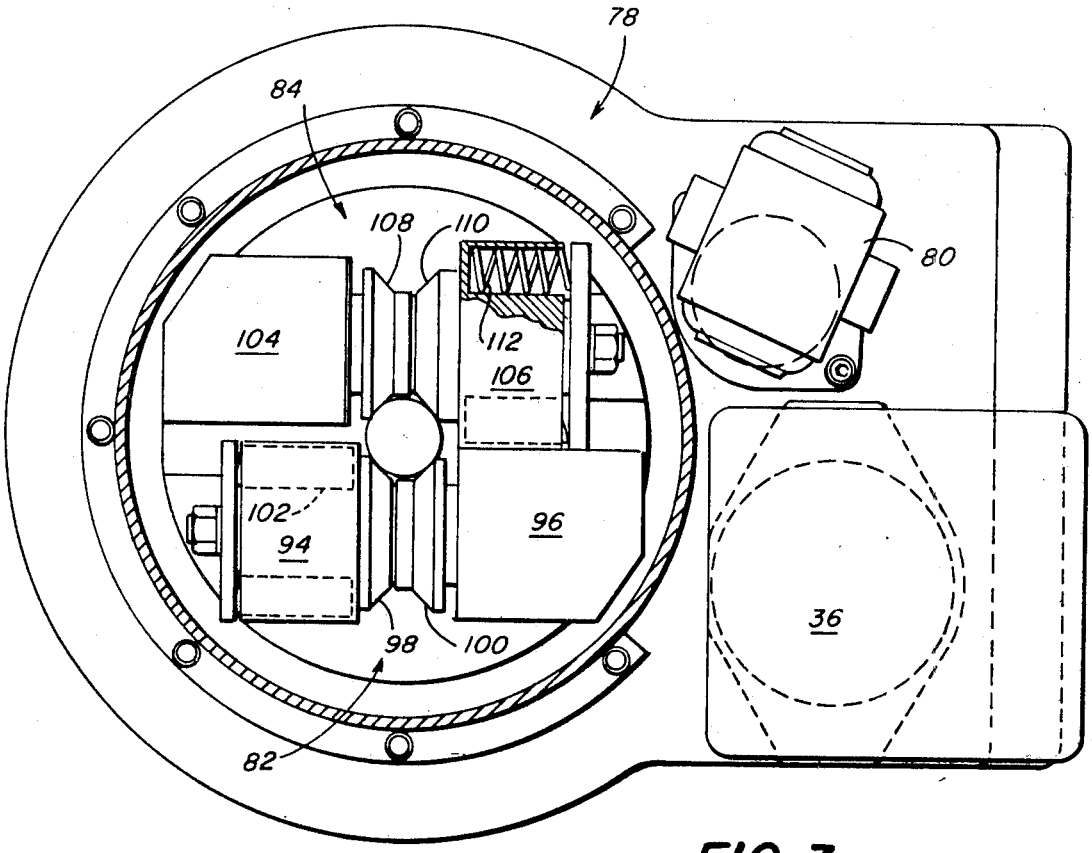
FIG 3
FIG. 2
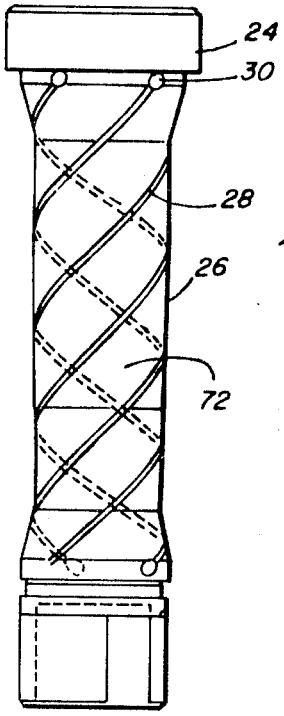
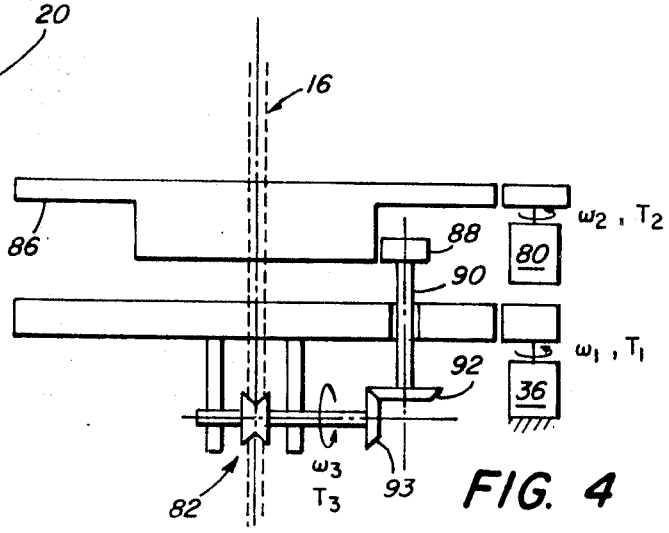
FIG. 4

TORQUER/THRUSTER

BACKGROUND OF THE INVENTION

1. Field of the Invention

The present invention relates to devices for rotating drill shafts and, more particularly, is directed towards devices for applying torque and thrust to flexible roof drills.

2. Description of the Prior Art

In the mining industry, falls of mine roofs account for a large percentage of the fatalities that occur in coal mines. Thus, roof control has been a major safety and production consideration. Roof fall fatalities have been greatly reduced in cases where the mine roof is supported with roof bolts that are inserted into holes which are drilled into the mine roof using a drill that is attached to a rigid shaft. As the holes become progressively deeper, the mine worker adds extension sections to the drill shaft. Such an operation requires the worker to be at the head of a roof drilling machine for starting the hole, for adding the extension sections and for inserting the bolts. In this hazardous position, the operator is exposed to both roof falls and the exposed rotating drill shaft.

Flexible roof drills eliminate the need for adding extension section and allow the operator to drill holes longer-than-the-seam height continuously and remotely. Machines that have been developed for applying torque and thrust to flexible roof drills have been met with varying degrees of success due to the height and the high hydraulic pressure requirements of such machines. A need has arisen for a reliable and simple machine for applying torque and thrust to flexible shaft roof drills.

SUMMARY OF THE INVENTION

An object of the present invention is to provide an improved torquer/thruster for applying rotational torque and longitudinal thrust to roof drills.

Another object of the invention is to provide a torquer/thruster of short height and having low hydraulic pressure requirements and a minimum amount of hydraulic seals.

A further object of the invention is to provide a torquer/thruster for applying torque and thrust to flexible roof drill shafts. The torquer/thruster includes a hydrostatically actuated chuck assembly with an elastomeric bladder that is fitted about a cylindrical collet. A flexible roof drill shaft is received within the collet. The collet is formed with a series of helically disposed slits, portions of the collet between adjacent slits drivingly engage the drill shaft when the bladder is urged against the collet. The bladder and collet are fixed against relative movement with respect to one another and are constrained within a piston assembly for rotational movement by a main driver. The piston assembly is mounted for limited longitudinal movement within a housing, the collet and bladder moving longitudinally with the piston assembly. A biased wheel assembly, which is driven by the main driver and an auxiliary driver, rotates with the collet and bladder. The biased wheel assembly engages the roof drill shaft for thrust assistance and retraction of the shaft. The relative torques of the main driver and auxiliary driver determine whether the wheel assembly urges the shaft in a forward direction or in a reverse direction. The chuck assembly engages the roof drill shaft when the piston assembly is moved in the forward direction for drill advancement and disengages the roof drill shaft when the piston is moved in the reverse direction. The wheel assembly prevents movement of the roof drill in the reverse direction when disengaged by the chuck assembly during the drilling operation.

Other objects of the present invention will in part be obvious and will in part appear hereinafter.

The invention accordingly comprises the apparatuses and systems, together with their parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein:

FIG. 2 is a side elevation of the collet of FIG. 1;

FIG. 3 is a sectional view taken along the lines 3—3 of FIG. 1; and FIG. 4 is a schematic diagram illustrating certain principles of the biased wheel assembly of FIG. 1.

DETAILED DESCRIPTION OF THE PREFERRED EMBODIMENTS

Figure 1:
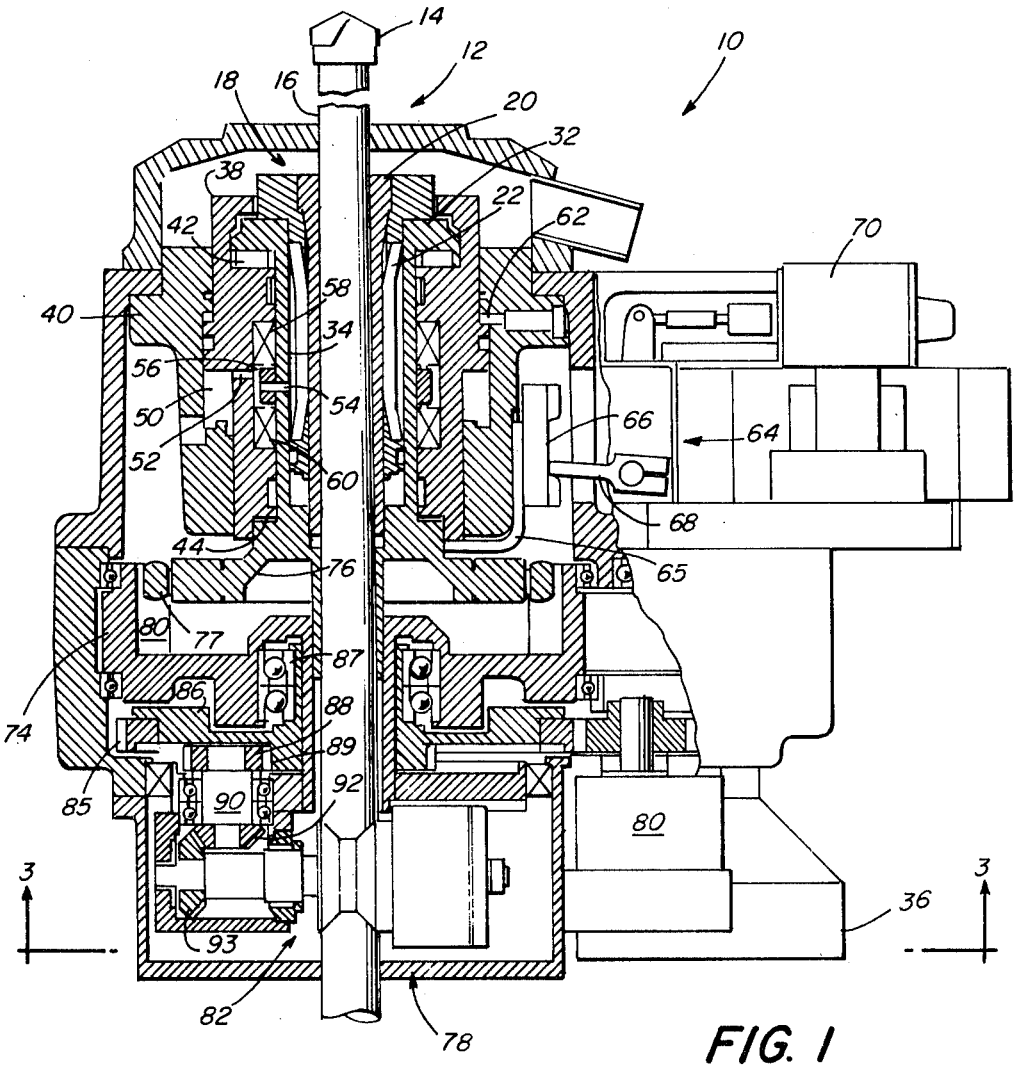
FIG. 1 is a sectional view of a torquer/thruster embodying the invention.

Referring now to the drawings, particularly FIG. 1, there is shown a torquer/thruster 10 embodying the invention for applying rotational torque and longitudinal thrust to a drill 12, for example a roof drill having a working head 14 at one end of a flexible shaft 16 that becomes substantially rigid when torque and thrust are applied thereto. A hydrostatically actuated chuck assembly 18, which is configured to receive and to drivingly engage shaft 16, includes an inner cylindrical collet 20 and an elastomeric boot or bladder 22. As shown in FIG. 2, collet 20, which is composed of an alloy steel for example, includes an upper flange 24 at one end of a hollow cylindrical body 26 which is formed with a plurality of slits 28 that are disposed in substantially helical paths about a longitudinal axis of the collet. Each slit 28 terminates in a substantially circular opening 30. Bladder 22 is fitted snugly about body 26 and is disposed between collet 20 and a collet holder 32. A chamber 34 for a fluid, for example a hydraulic fluid, is provided between collet holder 32 and bladder 22. Collet 20, bladder 22 and collet holder 32 are constrained against relative rotational movement with respect to one another and are drivingly connected to a main driver 36 for full rotational movement. Collet 20 and bladder 22 are constrained for limited axial movement within collet holder 32. Collet holder 32 is mounted within a hydraulically actuated piston 38 that is constrained for limited longitudinal movement and fixed against rotational movement in a housing 40. Collet holder 32, bladder 22 and collet 20 move longitudinally with piston 38. As previously indicated, collet holder 32, bladder 22 and collet 20 rotate together within piston 38. That is, piston 38, collet holder 32, bladder 22 and collet 20 move longitudinally as an integral unit and the collet holder, bladder and collet move rotationally as an integral unit within the piston which is fixed against rotational movement. A pair of thrust bearings 42 and 44 are provided between adjacent bearing surfaces of piston 38 and collet holder 32.

Piston 38 is moved upwardly by hydraulic fluid which enters a chamber 50 formed between housing 40 and a downwardly facing surface of piston 38. Chamber 50 communicates with chamber 34 via a port 52 formed in piston 38 and a port 54 formed in collet holder 32. Hydraulic fluid flows through a gap 56 which is bounded by a pair of rotary face seals 58 and 60 into chamber 34. Also, hydraulic fluid flows through a port 62 against an upwardly facing surface of piston 38 to move the piston downwardly when the hydraulic fluid flow into chamber 50 is cut off. A valve assembly 64, which is mounted to piston 38, includes an acutator 65 having a track 66, a cam follower 68 and a control valve 70 having first and second states. When piston 38 is moving upwardly, valve 70 is in its first state and hydraulic fluid flows into chambers 50 and 34. As piston 38 moves upwardly to its upper limit, cam follower 68 strikes the lower lip of track 66 and is rotated upwardly. The upward movement of cam follower 68 causes valve 70 to change into its second state, whereby the hydraulic fluid flow into chambers 50 and 34 is stopped. The hydraulic fluid flow through port 62 urges piston 38 downwardly and cam follower 68 is carried downwardly by the upper lip of track 66. As hereinafter described, when piston 38 is moved downwardly, shaft 16 is held in place. When piston 38 reaches its lower limit, cam follower 68 causes valve 70 to change into its first state and hydraulic fluid flows into chamber 50 and 34 for urging piston 38 upwardly and for urging bladder 22 against collet 20. The hydraulic flow through port 62 is maintained to provide back pressure on piston 38 so that bladder 22 can be urged against collet 20. In consequence, a lower portion of shaft 16 is engaged by collet 20 and the drilling operation continues. It will be apparent from the foregoing that valve assembly 64 constitutes a flip-flop valve which is actuated by longitudinal movement of piston 38 and controls the flow of hydraulic fluid for limiting longitudinal movement of the piston.

Helically disposed slits 28 provide positive gripping between collet 20 and flexible shaft 16. When bladder 22 is urged against collet 20 by application of the hydraulic fluid into chamber 34, sections 72 or flexure members of collet 20 between adjacent slits 28 are urged inwardly and body 26 elongates somewhat. The helical paths of slits 28 are such that the rotational movement of collet 20 increases the gripping force between the inner surface of the collet and the outer surface of shaft 16. The gripping force provided by helically slit collet 20 is analagous to that provided by a rotating capstan with several turns of loosely wound line wrapped around it. The capstan turns freely until the leading edge of the line is pulled slightly taut. This slight pull is sufficient to cause the line and capstan into gripping contact and to permit the capstan to transmit tremendous power to the line. A similar effect is provided by helically disposed flexure members 72 of collet 20 relative to shaft 16. The helically disposed slits 28 permit collet 20 to expand longitudinally and contract inwardly, whereby the inner surface of the collet bears uniformly against shaft 16. As previously indicated, collet holder 32, bladder 22 and collet 20 are rotated by main driver 36.

Driver 36 is drivingly connected to a bull gear 74 which rotates collet holder 32. A coupling flange 76 is mounted to the lower end of collet holder 32. Rollers 77, which are slidably received within longitudinal slots 80 formed in bull gear 74, are mounted to coupling flange 76. As collet holder 32 moves longitudinally, rollers 77 ride in longitudinal slots 80. The mechanical connection between coupling flange 76 and bull gear 74 is such as to permit limited, relative lateral movement therebetween to compensate for any misalignment that may occur between collet 20 and bull gear 74. A thrust assistance and retraction drive assembly 78 is provided to maintain thrust on shaft 16 when it is released by collet 20 during the drilling operation and to retract flexible roof drill 12 upon the completion of the roof drilling operation. As shown in FIG. 3, thrust assistance and drive assembly 78 includes an auxiliary driver 80 that is drivingly connected to a pair of drive members 82, 84 that engage shaft 16 and rotate with collet holder 32. Drive members 82 and 84 are positioned on opposite faces of shaft 16 and operate in the same manner. Therefore, the following description of the mechanical connections to drive member 82 and the description of the details of drive member 82 apply to drive member 84. Auxiliary driver 80 is drivingly connected to a ring gear 86 that rotates with bull gear 74 as it is driven by main driver 36. An input gear 88, which is fixed on end of a shaft 90, is driven by ring gear 86. A spiral miter gear 92, which is fixed on the other end of shaft 90, engages a drive gear 92 that drives drive member 82. Drive member 84 is driven by a similar arrangement of input, spiral miter and drive gears. The relationship between main driver 36 and auxiliary driver 80, for examply hydraulic motors, is illustrated schematically in FIG. 4.

Referring now to FIG. 4, the angular velocity $\omega_3$ of drive member 82 depends upon the angular velocity $\omega_1$ of main driver 36 and the angular velocity of $\omega_2$ of auxiliary driver 80. $\omega_3$ can be positive or negative and powers shaft 16 upwardly and downwardly. Torque $T_3$ on drive member 82 depends upon torque $T_1$ of main driver 36 and torque $T_2$ of auxiliary driver 80. Accordingly, the force exerted on shaft 16 depends upon torques $T_1$ and $T_2$. $T_1$ and $T_2$ depend upon the pressure across hydraulic main driver 36 and hydraulic auxiliary driver 80. Therefore, it is only necessary to control pressures and not match speeds in order to control the force on shaft 16. It will be readily apparent from the foregoing, that the thrust force applied to shaft 16 by drive members 82 and 84 is varied by the pressure applied across hydraulic motors 36 and 80. Auxiliary driver 80 constitutes an adjustment for controlling the thrust applied to shaft 16, either adding to or subtracting from the thrust applied to the shaft. The details of drive members 82 and 84 which bear against shaft 16 and transmit thrust thereto are shown in FIG. 3.

Drive member 82, which is drivingly connected to drive gear 92 includes a pair of housings 94 and 96 having tapered gripping heads 98 and 100, respectively. Heads 98 and 100 are biased towards each other by a bias element 102, for example a spring. Similarly, drive member 84 includes a pair of housings 104 and 106 having tapered gripping heads 108 and 110, respectively. Heads 108 and 110 are biased towards each other by a bias element 112, for example a spring. Shaft 116 is captively held between heads 98, 100 and 108, 110, thrust being applied to the flexible shaft by the gripping heads. As the diameter of shaft 16 varies, heads 98, 100 and heads 108, 110 move towards and away from each other while maintaining a gripping force on the shaft. It is to be noted that the centerline of shaft 16 remains in the same location regardless of variations in the diameter of the shaft.

Since ceratin changes may be made in the foregoing disclosure without departing from the scope of the invention herein involved, it is intended that all matter contained in the above description and depicted in the accompanying drawings be construed in an illustrative and not in a limiting sense.

What is claimed is:

1. A device for applying rotational torque and longitudinal thrust to a drill, said device comprising:

(a) a housing;

(b) cylindrical piston means mounted within said housing, said piston means fixed against rotational movement with respect to said housing and constrained for limited longitudinal movement with respect to said housing;

(c) collet means mounted within said piston means, said collet means including a collet holder and a collet, said collet holder mounted within said piston means, said collet constrained for longitudinal expansion and inward contraction, said collet configured to engage and to disengage a shaft of the drill;

(d) bladder means disposed between said piston means and said collet, said bladder means and said collet means fixed against movement with respect to one another, said bladder means and said collet means constrained for limited axial movement within said collet holder;

(e) means for longitudinally moving said piston means and for urging said bladder means against said collect for inwardly contracting and longitudinally expanding said collet, said collet captively engaging the drill shaft when said bladder means is urged against said collet, said piston means applying longitudinal thrust to a drill shaft captively engaged by said collet; and (f) drive means operatively connected to said collet means for rotating said collet means, whereby rotational torque is applies to the drill shaft captively engaged by said collet.

2. The device as claimed in claim 1 including thrust assistance and retraction means operatively connected to said drive means, said thrust assistance and retraction means rotating with said collet means and engaging the drill shaft captively engaged by said collet, said thrust assistance and retraction means configured to apply longitudinal thrust to the captively engaged drill shaft.

3. The device as claimed in claim 2 wherein said thrust assistance and retraction means includes a pair of drive members disposed on opposite surfaces of the drill shaft, each of said drive members including a pair of heads that are biased towards one another, the shaft engaged by each said pair of biased heads.

4. The device as claimed in claim 1 wherein said collet is a hollow cylindrical member formed with a plurality of longitudinal slits that are disposed in helical paths intermediate its ends.

5. The device as claimed in claim 4 wherein said urging means includes hydraulic means communicating with said piston means and said bladder means, said hydraulic means forcing said bladder means against the surface of said cylindrical collet, portions of said cylindrical collet between adjacent ones of said helically disposed slits drivingly engaging the drill shaft when said bladder is forced against said cylindrical collet;

6. The device as claimed in claim 5 wherein said hydraulic means includes flip-flop valve means responsive to longitudinal movement of said piston means, said flip-flop valve means having first and second states, said flip-flop valve means in said first state as said piston means is moving in a first direction for advancing the drill, said flip-flop valve means changing from its first state to its second state as said piston means reaches its limit in said first direction, said piston means moving in a second direction which is opposite said first direction when said flip-flop valve means is in its second state, said flip-flop valve means changing from its second state to its first state as said piston means reaches its limit in said second direction.

7. The device as claimed in claim 6 wherein said hydraulic means forces hydraulic fluid against a first selected surface of said piston means and said bladder means and causes said piston means to move in said first direction when said flip-flop valve means is in its first state, said hydraulic fluid forced against said first selected surface of said piston means and said bladder means effectively cut off and hydraulic fluid applied against a second selected surface of said piston means moving said piston means in said second direction when said flip-flop valve means is in its second state.

8. A device for applying rotational torque and longitudinal thrust to a roof drill having a flexible shaft, said device comprising:

(a) a housing;

(b) cylindrical piston means mounted within said housing, said piston means fixed against rotational movement with respect to said housing and constrained for limited longitudinal movement with respect to said housing;

(c) collet means mounted within said piston means, said collet means including a collet holder and a collet, said collet holder mounted within said piston means, said collet constrained for longitudinal expansion and inward contraction, said collet configured to engage and to disengage a shaft of the drill;

(d) bladder means disposed between said piston means and said collet, said bladder means and said collet fixed against movement with respect to one aother, said bladder means and said collet means constrained for limited axial movement within said collet holder;

(e) means for longitudinally moving said piston means and for urging said bladder means against said collet for inwardly contracting and longitudinally expanding said collet, said collet captively engaging the drill shaft when said bladder means is urged against said collet, said piston means applying longitudinal thrust to a drill shaft captively engaged by said collet;

(f) first drive means operatively connected to said collet means for rotating said collet means, whereby rotational torque is applied to the drill shaft captively engaged by said collet;

(g) thrust assistance and retraction means operatively connected to said first drive means and rotating with said collet means, the drill shaft engaged by said thrust assistance and retraction means, longitudinal thrust applied to the drill shaft by said thrust assistance and retraction means; and (h) second drive means operatively connected to said thrust assistance and retraction means for controlling the longitudinal thrust applied to the drill shaft by said thrust assistance and retraction means.

9. The device as claimed in claim 8 wherein said collet means is a hollow cylindrical member formed with a plurality of longitudinally extending slits disposed in helical paths intermediate its ends.

10. The device as claimed in claim 9 wherein said urging means includes hydraulic means communicating with said piston means and said bladder means, said hydraulic means longitudinally moving said piston means in a first direction and in a second direction, said first direction opposite said second direction, said hydraulic means forcing said bladder means against the surface of said cylindrical collet means as said piston means is moved in said first direction, portions of said cylindrical collet between adjacent ones of said helically disposed slits drivingly engaging the flexible drill shaft when said bladder is forced against said cylindrical collet.

11. The device as claimed in claim 10 wherein said hydraulic means includes flip-flop valve means responsive to longitudinal movement of said piston means, said flip-flop valve means having first and second states, said flip-flop valve means in said first state as said piston means is moving in said first direction for advancing the flexible drill, said flip-flop valve means changing from its first state to its second state as said piston means reaches its limit in said first direction, said piston means moving in said second direction when said flip-flop valve means is in its second state, said flip-flop valve means changing from its second state to its first state as said piston means reaches its limit in said second direction.

12. The device as claimed in claim 8 wherein said hydraulic means forces hydraulic fluid against a first selected surface of said piston means and said bladder means and causes said piston means to move in said first direction when said flip-flop valve means is in its first state, said hydraulic fluid forced against said first selected surface of said piston means and said bladder means effectively cut off and hydraulic fluid applied against a second selected surface of said piston means moving said piston means in said second direction when said flip-flop valve means is in its second state.

13. The device as claimed in claim 12 wherein said thrust assistance and retraction means includes a pair of drive members disposed on opposite surfaces of the drill shaft, each of said drive members including a pair of heads that are biased towards one another, the shaft engaged by each said pair of biased heads.

14. The device as claimed in claim 13 wherein said first drive means and said second drive means are hydraulic motors, the longitudinal thrust applied to the drill shaft by said drive members governed by the relative pressure applied to said first and second drive means, said second drive means selectively adding to and subtracting from the longitudinal thrust applied to the drill shaft by said first drive means.

15. The device as claimed in claim 8 wherein said collet is fixed against rotational movement within said collet holder.

* * * * *